US009185507B2

(12) United States Patent
Vinton et al.

(10) Patent No.: US 9,185,507 B2
(45) Date of Patent: Nov. 10, 2015

(54) HYBRID DERIVATION OF SURROUND SOUND AUDIO CHANNELS BY CONTROLLABLY COMBINING AMBIENCE AND MATRIX-DECODED SIGNAL COMPONENTS

(75) Inventors: Mark Stuart Vinton, San Francisco, CA (US); Mark F. Davis, Pacifica, CA (US); Charles Quito Robinson, Piedmont, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 807 days.

(21) Appl. No.: 12/663,276

(22) PCT Filed: Jun. 6, 2008

(86) PCT No.: PCT/US2008/007128

§ 371 (c)(1),
(2), (4) Date: Dec. 5, 2009

(87) PCT Pub. No.: WO2008/153944

PCT Pub. Date: Dec. 18, 2008

(65) Prior Publication Data

US 2010/0177903 A1 Jul. 15, 2010

Related U.S. Application Data

(60) Provisional application No. 60/933,789, filed on Jun. 8, 2007.

(51) Int. Cl.
*H04R 5/00* (2006.01)
*H04S 1/00* (2006.01)
(Continued)

(52) U.S. Cl.
CPC ..... *H04S 1/007* (2013.01); *G10L 19/008* (2013.01); *H04S 3/02* (2013.01); *H04S 2420/11* (2013.01)

(58) Field of Classification Search
CPC ..... H03S 3/02; H03S 3/008; H03S 2420/11
USPC ..... 381/19–22; 704/218
See application file for complete search history.

(56) References Cited

U.S. PATENT DOCUMENTS 7,003,467 B1 2/2006 Smith
7,039,198 B2 * 5/2006 Birchfield et al. ..... 381/92
(Continued)

FOREIGN PATENT DOCUMENTS

JP S61-093100 6/1986
JP H01-144900 6/1989
(Continued)

OTHER PUBLICATIONS

Avendano, C. et al., "Frequency Domain Techniques for Stereo to Multichannel Upmix", AES 22nd Intl Conf. on Virtual, Synthetic Entertainment Audio, Jun. 2002, pp. 1-10.
(Continued)

*Primary Examiner* — Xu Mei

(57) ABSTRACT

Ambience signal components are obtained from source audio signals, matrix-decoded signal components are obtained from the source audio signals, and the ambience signal components are controllably combined with the matrix-decoded signal components. Obtaining ambience signal components may include applying at least one decorrelation filter sequence. The same decorrelation filter sequence may be applied to each of the input audio signals or, alternatively, a different decorrelation filter sequence may be applied to each of the input audio signals.

23 Claims, 5 Drawing Sheets

(51) Int. Cl.
*G10L 19/008* (2013.01)
*H04S 3/02* (2006.01)

(56) References Cited

U.S. PATENT DOCUMENTS

| | | | | |
|---|---|---|---|---|
| 7,107,211 | B2 | 9/2006 | Griesinger | |
| 7,394,903 | B2 * | 7/2008 | Herre et al. | 381/23 |
| 7,844,453 | B2 * | 11/2010 | Hetherington | 704/228 |
| 8,213,623 | B2 * | 7/2012 | Faller | 381/26 |
| 2004/0122662 | A1 | 6/2004 | Crockett | |
| 2004/0133423 | A1 | 7/2004 | Crockett | |
| 2004/0148159 | A1 | 7/2004 | Crockett | |
| 2004/0165730 | A1 | 8/2004 | Crockett | |
| 2004/0172240 | A1 | 9/2004 | Crockett | |
| 2006/0029239 | A1 | 2/2006 | Smithers | |
| 2006/0262936 | A1 | 11/2006 | Sato | |
| 2007/0269063 | A1 * | 11/2007 | Goodwin et al. | 381/310 |
| 2008/0205676 | A1 * | 8/2008 | Merimaa et al. | 381/310 |

FOREIGN PATENT DOCUMENTS

| | | | |
|---|---|---|---|
| JP | H05-050898 | | 7/1993 |
| JP | 2005-512434 | | 4/2005 |
| JP | 2007-028065 | | 2/2007 |
| KR | 10-2003-0038786 | | 5/2003 |
| RU | 2193827 | | 11/2002 |
| RU | 2234819 | | 8/2004 |
| WO | 9526083 | | 9/1995 |
| WO | 2005002278 | | 1/2005 |
| WO | 2006132857 | A2 | 12/2006 |
| WO | 2007016107 | A2 | 2/2007 |
| WO | 2007106324 | A1 | 9/2007 |
| WO | 2007127023 | A1 | 11/2007 |

OTHER PUBLICATIONS

Zwicker, H., et al., "Psycho-acoustics, Facts and Models; 8. Loudness", Second Updated Edition, Springer, 1990, pp. 203-238.

Crockett, B., "Improved Transient Pre-Noise Performance of Low Bit Rate Audio Coders Using Time Scaling Synthesis", Paper No. 6184, 117th AES Conference, San Francisco, CA, Oct. 28-31, 2004, pp. 1-10.

Seefeldt, A., et al., "New Tecnhiques in Spatial Audio Coding", Paper No. 6587, 119th AES Conference, New York, Oct. 7-10, 2005, pp. 1-13.

Faller, C., "Matrix Surround Revisited", AES 30th Intl Conference, Mar. 15, 2007, pp. 1-7.

EPO ISA, Notification of Transmittal of the Intl Search Report and the Written Opinion of the Intl Searching Authority, or the Declaration, mailed Sep. 10, 2008.

* cited by examiner

HYBRID DERIVATION OF SURROUND SOUND AUDIO CHANNELS BY CONTROLLABLY COMBINING AMBIENCE AND MATRIX-DECODED SIGNAL COMPONENTS

TECHNICAL FIELD

The invention relates to audio signal processing. More particularly, it relates to obtaining ambience signal components from source audio signals, obtaining matrix-decoded signal components from the source audio signals, and controllably combining the ambience signal components with the matrix-decoded signal components.

INCORPORATION BY REFERENCE

The following references are hereby incorporated by reference, each in their entirety.

[1] C. Avendano and Jean-Marc Jot, "Frequency Domain Techniques for Stereo to Multichannel Upmix," AES 22$^{nd}$ Int. Conf. on Virtual, Synthetic Entertainment Audio;

[2] E. Zwicker, H. Fastl, "Psycho-acoustics," Second Edition, Springer, 1990, Germany;

[3] B. Crockett, "Improved Transient Pre-Noise Performance of Low Bit Rate Audio Coders Using Time Scaling Synthesis," Paper No. 6184, 117th AES Conference, San Francisco, October 2004;

[4] U.S. patent application Ser. No. 10/478,538, PCT filed Feb. 26, 2002, published as US 2004/0165730 A1 on Aug. 26, 2004, "Segmenting Audio Signals into Auditory Events," Brett G. Crockett.

[5] A. Seefeldt, M. Vinton, C. Robinson, "New Techniques in Spatial Audio Coding," Paper No. 6587, 119$^{th}$ AES Conference, New York, October 2005.

[6] U.S. patent application Ser. No. 10/474,387, PCT filed Feb. 12, 2002, published as US 2004/0122662 A1 on Jun. 24, 2004, "High Quality Time-Scaling and Pitch-Scaling of Audio Signals," Brett Graham Crockett.

[7] U.S. patent application Ser. No. 10/476,347, PCT filed Apr. 25, 2002, published as US 2004/0133423 A1 on Jul. 8, 2004, "Transient Performance of Low Bit Rate Audio Coding Systems By Reducing Pre-Noise," Brett Graham Crockett.

[8] U.S. patent application Ser. No. 10/478,397, PCT filed Feb. 22, 2002, published as US 2004/0172240 A1 on Jul. 8, 2004, "Comparing Audio Using Characterizations Based on Auditory Events," Brett G. Crockett et al.

[9] U.S. patent application Ser. No. 10/478,398, PCT filed Feb. 25, 2002, published as US 2004/0148159 A1 on Jul. 29, 2004, "Method for Time Aligning Audio Signals Using Characterizations Based on Auditory Events," Brett G. Crockett et al.

[10] U.S. patent application Ser. No. 10/478,398, PCT filed Feb. 25, 2002, published as US 2004/0148159 A1 on Jul. 29, 2004, "Method for Time Aligning Audio Signals Using Characterizations Based on Auditory Events," Brett G. Crockett et al.

[11] U.S. patent application Ser. No. 10/911,404, PCT filed Aug. 3, 2004, published as US 2006/0029239 A1 on Feb. 9, 2006, "Method for Combining Audio Signals Using Auditory Scene Analysis," Michael John Smithers.

[12] International Application Published Under the Patent Cooperation Treaty, PCT/US2006/020882, International Filing Date 26 May 2006, designating the United States, published as WO 2006/132857 A2 and A3 on 14 Dec. 2006, "Channel Reconfiguration With Side Information," Alan Jeffrey Seefeldt, et al.

[13] International Application Published Under the Patent Cooperation Treaty, PCT/US2006/028874, International Filing Date 24 Jul. 2006, designating the United States, published as WO 2007/016107 A2 on 8 Feb. 2007, "Controlling Spatial Audio Coding Parameters as a Function of Auditory Events," Alan Jeffrey Seefeldt, et al.

[14] International Application Published Under the Patent Cooperation Treaty, PCT/US2007/004904, International Filing Date 22 Feb. 2007, designating the United States, published as WO 2007/106234 A1 on 20 Sep. 2007, "Rendering Center Channel Audio," Mark Stuart Vinton.

[15] International Application Published Under the Patent Cooperation Treaty, PCT/US2007/008313, International Filing Date 30 Mar. 2007, designating the United States, published as WO 2007/127023 on 8 Nov. 2007, "Audio Gain Control Using Specific Loudness-Based Auditory Event Detection," Brett G. Crockett, et al.

BACKGROUND ART

Creating multichannel audio material from either standard matrix encoded two-channel stereophonic material (in which the channels are often designated "Lt" and "Rt") or non-matrix encoded two-channel stereophonic material (in which the channels are often designated "Lo" and "Ro") is enhanced by the derivation of surround channels. However, the role of the surround channels for each signal type (matrix and non-matrix encoded material) is quite different. For non-matrix encoded material, using the surround channels to emphasize the ambience of the original material often produces audibly-pleasing results. However, for matrix-encoded material it is desirable to recreate or approximate the original surround channels' panned sound images. Furthermore, it is desirable to provide an arrangement that automatically processes the surround channels in the most appropriate way, regardless of the input type (either non-matrix or matrix encoded), without the need for the listener to select a decoding mode.

Currently there are many techniques for upmixing two channels to multiple channels. Such techniques range from simple fixed or passive matrix decoders to active matrix decoders as well as ambience extraction techniques for surround channel derivation. More recently, frequency domain ambience extraction techniques for deriving the surround channels (see, for example, reference 1) have shown promise for creating enjoyable multichannel experiences. However, such techniques do not re-render surround channel images from matrix encoded (LtRt) material because they are primarily designed for non-matrix encoded (LoRo) material. Alternatively, passive and active matrix decoders do a reasonably good job of isolating surround-panned images for matrix-encoded material. However, ambience extraction techniques provide better performance for non-matrix encoded material than does matrix decoding.

With the current generation of upmixers the listener is often required to switch the upmixing system to select the one that best matches the input audio material. It is therefore an object of the present invention to create surround channel signals that are audibly pleasing for both matrix and non-matrix encoded material without any requirement for a user to switch between decoding modes of operation.

DISCLOSURE OF THE INVENTION

In accordance with aspects of the present invention, a method for obtaining two surround sound audio channels from two input audio signals, wherein the audio signals may include components generated by matrix encoding, comprises obtaining ambience signal components from the audio signals, obtaining matrix-decoded signal components from the audio signals, and controllably combining ambience signal components and matrix-decoded signal components to provide the surround sound audio channels. Obtaining ambience signal components may include applying a dynamically changing ambience signal component gain scale factor to an input audio signal. The ambience signal component gain scale factor may be a function of a measure of cross-correlation of the input audio signals, in which, for example, the ambience signal component gain scale factor decreases as the degree of cross-correlation increases and vice-versa. The measure of cross-correlation may be temporally smoothed and, for example, the measure of cross-correlation may be temporally smoothed by employing a signal dependent leaky integrator or, alternatively, by employing a moving average. The temporal smoothing may be signal adaptive such that, for example, the temporal smoothing adapts in response to changes in spectral distribution.

In accordance with aspects of the present invention, obtaining ambience signal components may include applying at least one decorrelation filter sequence. The same decorrelation filter sequence may be applied to each of the input audio signals or, alternatively, a different decorrelation filter sequence may be applied to each of the input audio signals.

In accordance with further aspects of the present invention, obtaining matrix-decoded signal components may include applying a matrix decoding to the input audio signals, which matrix decoding is adapted to provide first and second audio signals each associated with a rear surround sound direction.

Controllably combining may include applying gain scale factors. The gain scale factors may include the dynamically changing ambience signal component gain scale factor applied in obtaining ambience signal components. The gain scale factors may further include a dynamically changing matrix-decoded signal component gain scale factor applied to each of the first and second audio signals associated with a rear surround sound direction. The matrix-decoded signal component gain scale factor may be a function of a measure of cross-correlation of the input audio signals, wherein, for example, the dynamically changing matrix-decoded signal component gain scale factor increases as the degree of cross-correlation increases and decreases as the degree of cross-correlation decreases. The dynamically changing matrix-decoded signal component gain scale factor and the dynamically changing ambience signal component gain scale factor may increase and decrease with respect to each other in a manner that preserves the combined energy of the matrix-decoded signal components and ambience signal components. The gain scale factors may further include a dynamically changing surround sound audio channels' gain scale factor for further controlling the gain of the surround sound audio channels. The surround sound audio channels' gain scale factor may be a function of a measure of cross-correlation of the input audio signals in which, for example, the function causes the surround sound audio channels gain scale factor to increase as the measure of cross-correlation decreases up to a value below which the surround sound audio channels' gain scale factor decreases.

Various aspects of the present invention may be performed in the time-frequency domain, wherein, for example, aspects of the invention may be performed in one or more frequency bands in the time-frequency domain.

Upmixing either matrix encoded two-channel audio material or non-matrix encoded two-channel material typically requires the generation of surround channels. Well-known matrix decoding systems work well for matrix encoded material, while ambience "extraction" techniques work well for non-matrix encoded material. To avoid the need for the listener to switch between two modes of upmixing, aspects of the present invention variably blend between matrix decoding and ambience extraction to provide automatically an appropriate upmix for a current input signal type. To achieve this, a measure of cross correlation between the original input channels controls the proportion of direct signal components from a partial matrix decoder ("partial" in the sense that the matrix decoder only needs to decode the surround channels) and ambient signal components. If the two input channels are highly correlated, then more direct signal components than ambience signal components are applied to the surround channel channels. Conversely, if the two input channels are decorrelated, then more ambience signal components than direct signal components are applied to the surround channel channels.

Ambience extraction techniques, such as those disclosed in reference 1, remove ambient audio components from the original front channels and pan them to surround channels, which may reinforce the width of the front channels and improve the sense of envelopment. However, ambience extraction techniques do not pan discrete images to the surround channels. On the other hand, matrix-decoding techniques do a relatively good job of panning direct images ("direct" in the sense of a sound having a direct path from source to listener location in contrast to a reverberant or ambient sound that is reflected or "indirect") to surround channels and, hence, are able to reconstruct matrix-encoded material more faithfully. To take advantage of the strengths of both decoding systems, a hybrid of ambience extraction and matrix decoding is an aspect of the present invention.

A goal of the invention is to create an audibly pleasing multichannel signal from a two-channel signal that is either matrix encoded or non-matrix encoded without the need for a listener to switch modes. For simplicity, the invention is described in the context of a four-channel system employing left, right, left surround, and right surround channels. The invention, however, may be extended to five channels or more. Although any of various known techniques for providing a center channel as the fifth channel may be employed, a particularly useful technique is described in an international application published under the Patent Cooperation Treaty WO 2007/106324 A1, filed Feb. 22, 2007 and published Sep. 20, 2007, entitled "Rendering Center Channel Audio" by Mark Stuart Vinton. Said WO 2007/106324 A1 publication is hereby incorporated by reference in its entirety.

DESCRIPTION OF THE DRAWINGS

FIG. 6 shows a schematic of the signal flow in one of multiple frequency bands, it being understood that the combined actions in all of the multiple frequency bands produce the surround sound audio channels $L_S$ and $R_S$.

BEST MODE FOR CURRYING OUT THE INVENTION

Figure 1:
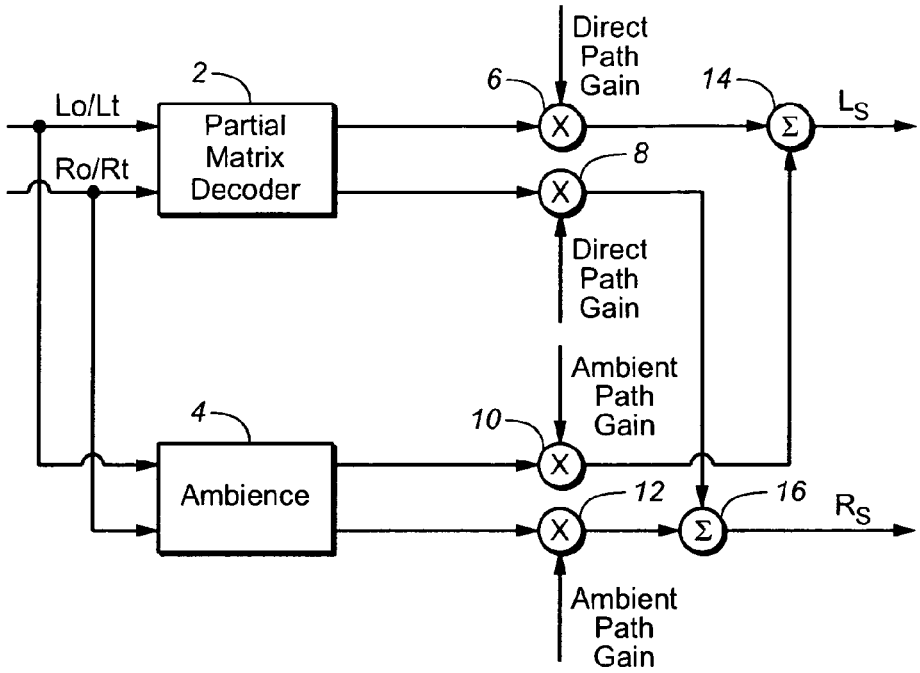
FIG. 1 shows a schematic functional block diagram of a device or process for deriving two surround sound audio channels from two input audio signals in accordance with aspects of the present invention.

FIG. 1 shows a schematic functional block diagram of a device or process for deriving two surround sound audio channels from two input audio signals in accordance with aspects of the present invention. The input audio signals may include components generated by matrix encoding. The input audio signals may be two stereophonic audio channels, generally representing left and right sound directions. As mentioned above, for standard matrix-encoded two-channel stereophonic material the channels are often designated "Lt" and "Rt," and for non-matrix encoded two-channel stereophonic material, the channels are often designated "Lo" and "Ro." Thus, to indicate that the input audio signals may be matrix-encoded at some times and not matrix-encoded at other times, the inputs are labeled "Lo/Lt" and "Ro/Rt" in FIG. 1.

Both input audio signals in the FIG. 1 example are applied to a partial matrix decoder or decoding function ("Partial Matrix Decoder") 2 that generates matrix-decoded signal components in response to the pair of input audio signals. Matrix-decoded signal components are obtained from the two input audio signals. In particular, Partial Matrix Decode 2 is adapted to provide first and second audio signals each associated with a rear surround sound direction (such as left surround and right surround). Thus, for example, Partial Matrix Decode 2 may be implemented as the surround channels portion of a 2:4 matrix decoder or decoding function (i.e., a "partial" matrix decoder or decoding function). The matrix decoder may be passive or active. Partial Matrix Decode 2 may be characterized as being in a "direct signal path (or paths)" (where "direct" is used in the sense explained above) (see FIG. 6, described below).

In the example of FIG. 1, both inputs are also applied to Ambience 4 that may be any of various well known ambience generating, deriving or extracting devices or functions that operate in response to one or two input audio signals to provide one or two ambience signal components outputs. Ambience signal components are obtained from the two input audio signals. Ambience 4 may include devices and functions (1) in which ambience may be characterized as being "extracted" from the input signal(s) (in the manner, for example, of a 1950's Hafler ambience extractor in which one or more difference signals (L-R, R-L) are derived from Left and Right stereophonic signals or a modern time-frequency-domain ambience extractor as in reference (1) and (2) in which ambience may be characterized as being "added" to or "generated" in response to the input signal(s) ((in the manner, for example, of a digital (delay line, convolver, etc.) or analog (chamber, plate, spring, delay line, etc.) reverberator)).

In modern frequency-domain ambience extractors, ambience extraction may be achieved by monitoring the cross correlation between the input channels, and extracting components of the signal in time and/or frequency that are decorrelated (have a small correlation coefficient, close to zero). To further enhance the ambience extraction, decorrelation may be applied in the ambience signal path to improve the sense of front/back separation. Such decorrelation should not be confused with the extracted decorrelated signal components or the processes or devices used to extract them. The purpose of such decorrelation is to reduce any residual correlation between the front channels and the obtained surround channels. See heading below "Decorrelators for Surround Channels."

In the case of one input audio signal and two ambience output signals, the two input audio signals may be combined, or only one of them used. In the case of two inputs and one output, the same output may be used for both ambience signal outputs. In the case of two inputs and two outputs, the device or function may operate independently on each input so that each ambience signal output is in response to only one particular input, or, alternatively, the two outputs may be in response and dependent upon both inputs. Ambience 4 may be characterized as being in an "ambience signal path (or paths)."

In the example of FIG. 1, the ambience signal components and matrix-decoded signal components are controllably combined to provide two surround sound audio channels. This may be accomplished in the manner shown in FIG. 1 or in an equivalent manner. In the example of FIG. 1, a dynamically-changing matrix-decoded signal component gain scale factor is applied to both of the Partial Matrix Decode 2 outputs. This is shown as the application of the same "Direct Path Gain" scale factor to each of two multipliers 6 and 8, each in an output path of Partial Matrix Decode 2. A dynamically-changing ambience signal component gain scale factor is applied to both of the Ambience 4 outputs. This is shown as the application of the same "Ambient Path Gain" scale factor to each of two multipliers 10 and 12, each in an output of Ambience 4. The dynamically-gain-adjusted matrix-decode output of multiplier 6 is summed with the dynamically-gain-adjusted ambience output of multiplier 10 in an additive combiner 14 (shown as a summation symbol Σ) to produce one of the surround sound outputs. The dynamically-gain-adjusted matrix-decode output of multiplier 8 is summed with the dynamically-gain-adjusted ambience output of multiplier 12 in an additive combiner 16 (shown as a summation symbol Σ) to produce the other one of the surround sound outputs. To provide the left surround ($L_S$) output from combiner 14, the gain-adjusted partial matrix decode signal from multiplier 6 should be obtained from the left surround output of Partial Matrix Decode 2 and the gain adjusted ambience signal from multiplier 10 should be obtained from an Ambience 4 output intended for the left surround output. Similarly, to provide the right surround ($R_S$) output from combiner 16, the gain-adjusted partial matrix decode signal from multiplier 8 should the obtained from the right surround output of Partial Matrix Decode 2 and the gain adjusted ambience signal from multiplier 12 should be obtained from an Ambience 4 output intended for the right surround output.

The application of dynamically-changing gain scale factors to a signal that feeds a surround sound output may be characterized as a "panning" of that signal to and from such a surround sound output.

The direct signal path and the ambience signal path are gain adjusted to provide the appropriate amount of direct signal audio and ambient signal audio based on the incoming signal. If the input signals are well correlated, then a large proportion of the direct signal path should be present in the final surround channel signals. Alternatively, if the input signals are substantially decorrelated then a large proportion of the ambience signal path should be present in the final surround channel signals.

Because some of the sound energy of the input signals is passed to the surround channels, it may be desirable, in addition, to adjust the gains of the front channels, so that the total reproduced sound pressure is substantially unchanged. See the example of FIG. 2.

It should be noted that when a time-frequency-domain ambience extraction technique as in reference 1 is employed, the ambience extraction may be accomplished by the application of a suitable dynamically-changing ambience signal component gain scale factor to each of the input audio signals. In that case, the Ambience 4 block may be considered to include the multipliers 10 and 12, such that the Ambient Path Gain scale factor is applied to each of the audio input signals Lo/Lt and Ro/Rt independently.

In its broadest aspects, the invention, as characterized in the example of FIG. 1, may be implemented (1) in the time-frequency domain or the frequency domain, (2) on a wide-band or banded basis (referring to frequency bands), and (3) in an analog, digital or hybrid analog/digital manner.

While the technique of cross blending partial matrix decoded audio material with ambience signals to create the surround channels can be done in a broadband manner, performance may be improved by computing the desired surround channels in each of a plurality of frequency bands. One possible way to derive the desired surround channels in frequency bands is to employ an overlapped short time discrete Fourier transform for both analysis of the original two-channel signal and the final synthesis of the multichannel signal. There are however, many more well-known techniques that allow signal segmentation into both time and frequency for analysis and synthesis (e.g., filterbanks, quadrature mirror filters, etc.).

Figure 2:
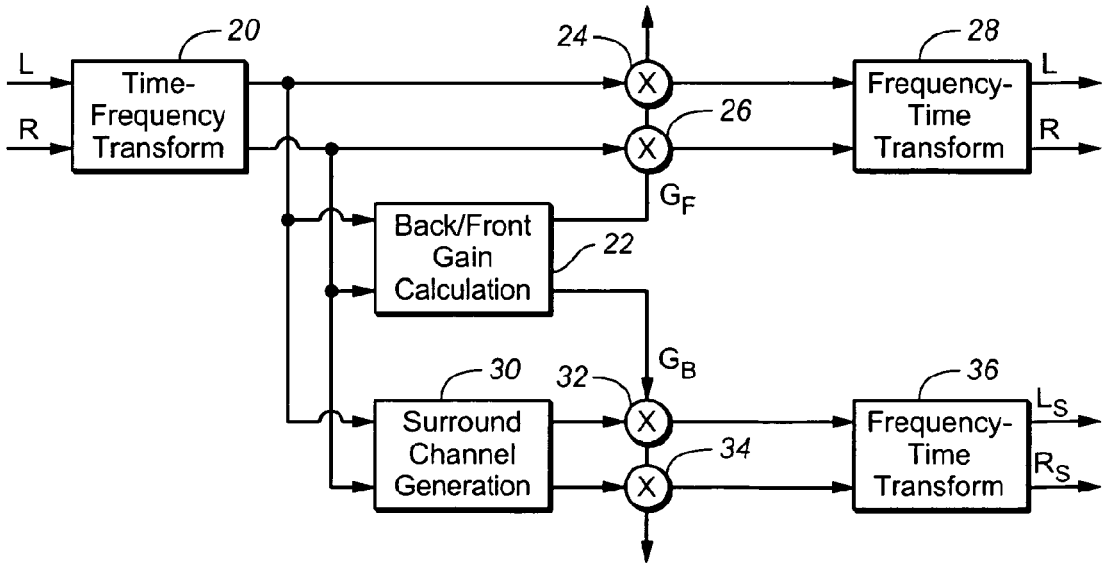
FIG. 2 shows a schematic functional block diagram of an audio upmixer or upmixing process in accordance with aspects of the present invention in which processing is performed in the time-frequency-domain. A portion of the FIG. 2 arrangement includes a time-frequency domain embodiment of the device or process of FIG. 1.

FIG. 2 shows a schematic functional block diagram of an audio upmixer or upmixing process in accordance with aspects of the present invention in which processing is performed in the time-frequency-domain. A portion of the FIG. 2 arrangement includes a time-frequency domain embodiment of the device or process of FIG. 1. A pair of stereophonic input signals Lo/Lt and Ro/Rt are applied to the upmixer or upmixing process. In the example of FIG. 2 and other examples herein in which processing is performed in the time-frequency domain, the gain scale factors may be dynamically updated as often as the transform block rate or at a time-smoothed block rate.

Although, in principle, aspects of the invention may be practiced by analog, digital or hybrid analog/digital embodiments, the example of FIG. 2 and other examples discussed below are digital embodiments. Thus, the input signals may be time samples that may have been derived from analog audio signals. The time samples may be encoded as linear pulse-code modulation (PCM) signals. Each linear PCM audio input signal may be processed by a filterbank function or device having both an in-phase and a quadrature output, such as a 2048-point windowed a short time discrete Fourier transform (STDFT).

Thus, the two-channel stereophonic input signals may be converted to the frequency domain using a short time discrete Fourier transform (STDFT) device or process ("Time-Frequency Transform") 20 and grouped into bands (grouping not shown). Each band may be processed independently. A control path calculates in a device or function (Back/Front Gain Calculation") 22 the front/back gain scale factor ratios ($G_F$ and $G_B$) (see Eqns. 12 and 13 and FIG. 7 and its description, below). For a four-channel system, the two input signals may be multiplied by the front gain scale factor $G_F$ (shown as multiplier symbols 24 and 26) and passed through an inverse transform or transform process ("Frequency-Time Transform") 28 to provide the left and right output channels L'o/L't and R'o/R't, which may differ in level from the input signals due to the $G_F$ gain scaling. The surround channel signals $L_S$ and $R_S$, obtained from a time-frequency domain version of the device or process of FIG. 1 ("Surround Channel Generation") 30, which represent a variable blend of ambience audio components and matrix-decoded audio components, are multiplied by the back gain scale factor $G_B$ (shown as multiplier symbols 32 and 34) prior to an inverse transform or transform process ("Frequency-Time Transform") 36.

Time-Frequency Transform 20

Figure 3:
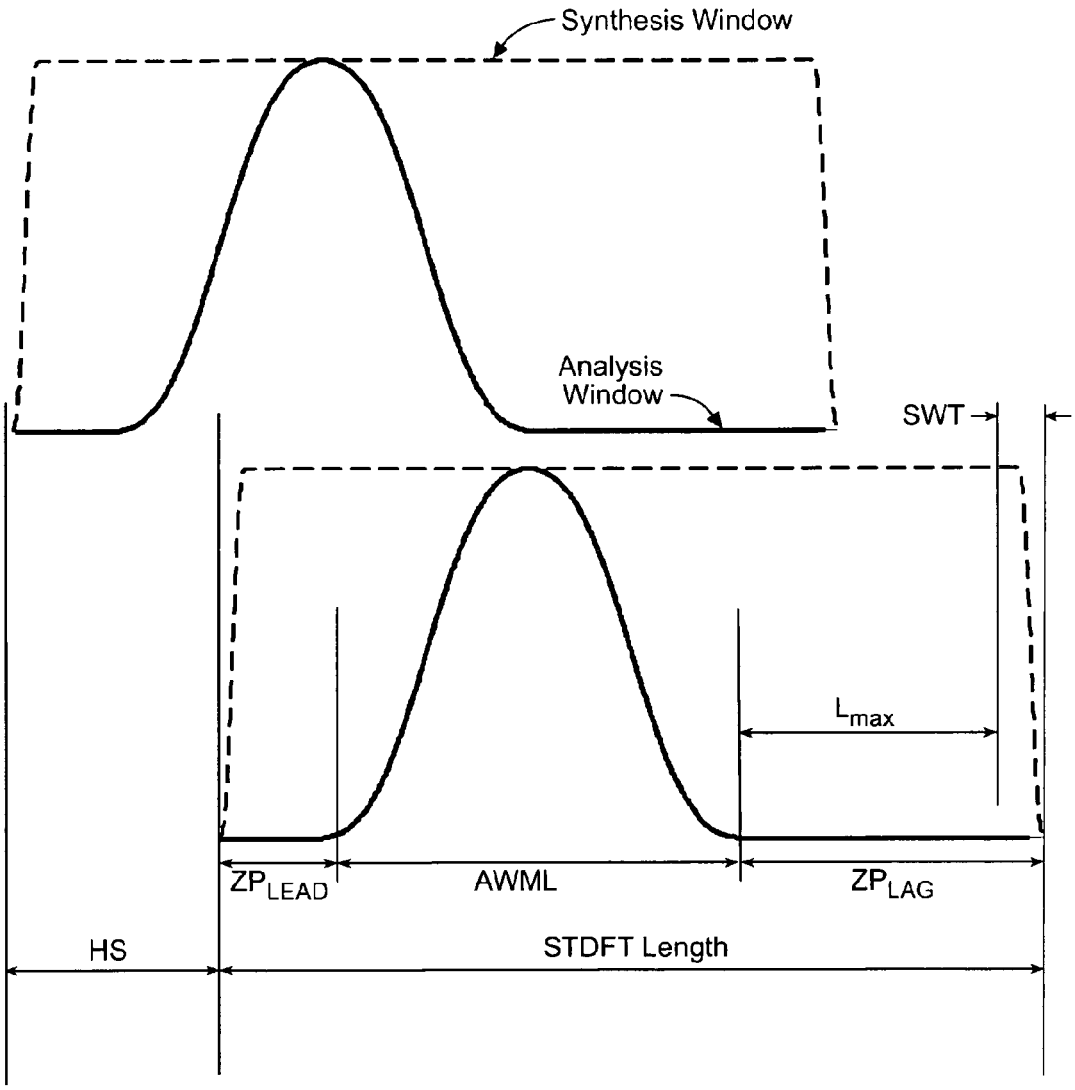
FIG. 3 depicts a suitable analysis/synthesis window pair for two consecutive short time discrete Fourier transform (STDFT) time blocks usable in a time-frequency transform that may be employed in practicing aspects of the present invention.

The Time-Frequency Transform 20 used to generate two surround channels from the input two-channel signal may be based on the well known short time discrete Fourier transform (STDFT). To minimize circular convolution effects, a 75% overlap may be used for both analysis and synthesis. With the proper choice of analysis and synthesis windows, an overlapped STDFT may be used to minimize audible circular convolution effects, while providing the ability to apply magnitude and phase modifications to the spectrum. Although the particular window pair is not critical, FIG. 3 depicts a suitable analysis/synthesis window pair for two consecutive STDFT time blocks.

The analysis window is designed so that the sum of the overlapped analysis windows is equal to unity for the chosen overlap spacing. The square of a Kaiser-Bessel-Derived (KBD) window may be employed, although the use of that particular window is not critical to the invention. With such an analysis window, one may synthesize an analyzed signal perfectly with no synthesis window if no modifications have been made to the overlapping STDFTs. However, due to the magnitude alterations applied and the decorrelation sequences used in this exemplary embodiment, it is desirable to taper the synthesis window to prevent audible block discontinuities. The window parameters used in an exemplary spatial audio coding system are listed below.

STDFT Length: 2048
Analysis Window Main-Lobe Length (AWML): 1024
Hop Size (HS): 512
Leading Zero-Pad ($ZP_{lead}$): 256
Lagging Zero-Pad ($ZP_{lag}$): 768
Synthesis Window Taper (SWT): 128

Banding

Figure 4:
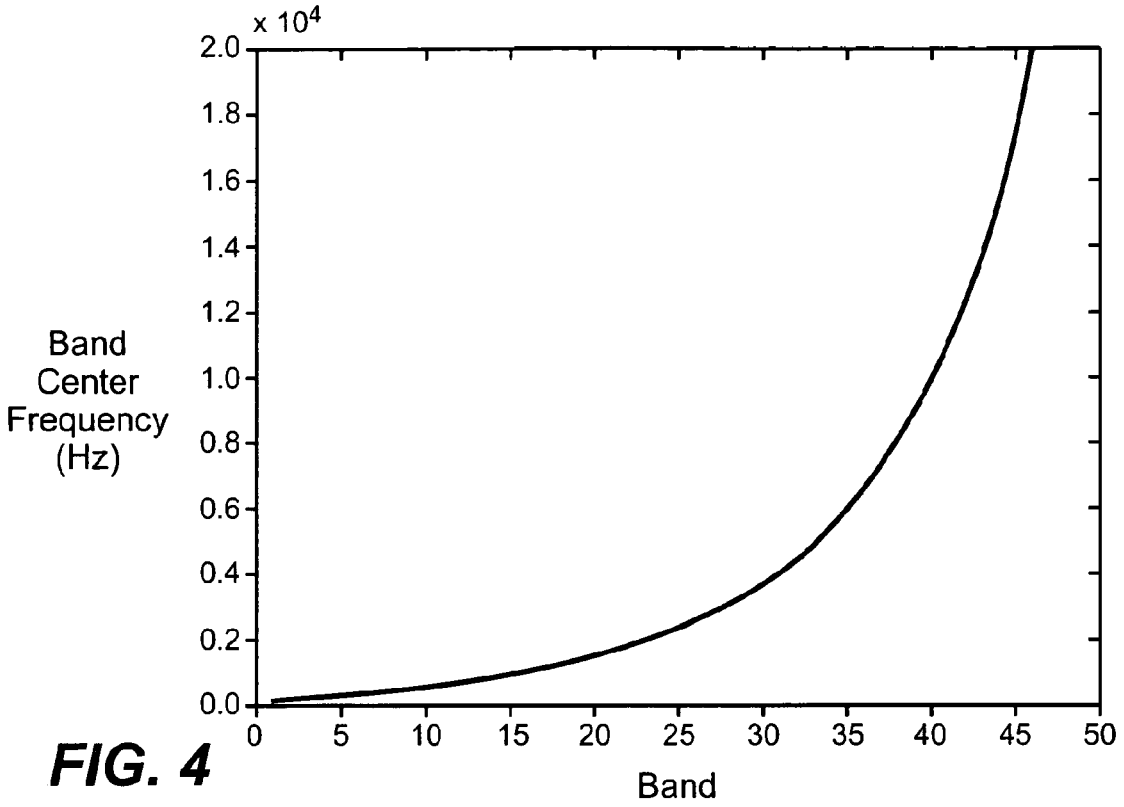
FIG. 4 shows a plot of the center frequency of each band in Hertz for a sample rate of 44100 Hz that may be employed in practicing aspects of the present invention in which gain scale factors are applied to respective coefficients in spectral bands each having approximately a half critical-band width.

An exemplary embodiment of the upmixing according to aspects of the present invention computes and applies the gain scale factors to respective coefficients in spectral bands with approximately half critical-band width (see, for example, reference 2). FIG. 4 shows a plot of the center frequency of each band in Hertz for a sample rate of 44100 Hz, and Table 1 gives the center frequency for each band for a sample rate of 44100 Hz.

TABLE 1

Center frequency of each band in Hertz for a sample rate of 44100 Hz

| Band Number | Center Frequency (Hz) |
|---|---|
| 1 | 33 |
| 2 | 65 |
| 3 | 129 |
| 4 | 221 |
| 5 | 289 |
| 6 | 356 |
| 7 | 409 |
| 8 | 488 |
| 9 | 553 |
| 10 | 618 |
| 11 | 684 |
| 12 | 749 |
| 13 | 835 |
| 14 | 922 |
| 15 | 1008 |
| 16 | 1083 |
| 17 | 1203 |
| 18 | 1311 |
| 19 | 1407 |
| 20 | 1515 |
| 21 | 1655 |
| 22 | 1794 |
| 23 | 1955 |
| 24 | 2095 |
| 25 | 2288 |
| 26 | 2492 |
| 27 | 2728 |
| 28 | 2985 |
| 29 | 3253 |
| 30 | 3575 |
| 31 | 3939 |
| 32 | 4348 |
| 33 | 4798 |
| 34 | 5301 |
| 35 | 5859 |
| 36 | 6514 |
| 37 | 7190 |
| 38 | 7963 |
| 39 | 8820 |
| 40 | 9807 |
| 41 | 10900 |
| 42 | 12162 |
| 43 | 13616 |
| 44 | 15315 |
| 45 | 17331 |
| 46 | 19957 |

Signal Adaptive Leaky Integrators

In the exemplary upmixing arrangement according to aspects of the invention, each statistic and variable is first calculated over a spectral band and then smoothed over time. The temporal smoothing of each variable is a simple first order IIR as shown in Eqn. 1. However, the alpha parameter preferably adapts with time. If an auditory event is detected (see, for example, reference 3 or reference 4), the alpha parameter is decreased to a lower value and then it builds back up to a higher value over time. Thus, the system updates more rapidly during changes in the audio.

An auditory event may be defined as an abrupt change in the audio signal, for example the change of note of an instrument or the onset of a speaker's voice. Hence, it makes sense for the upmixing to rapidly change its statistical estimates near a point of event detection. Furthermore, the human auditory system is less sensitive during the onset of transients/events, thus, such moments in an audio segment may be used to hide the instability of the systems estimations of statistical quantities. An event may be detected by changes in spectral distribution between two adjacent blocks in time.

Figure 5:
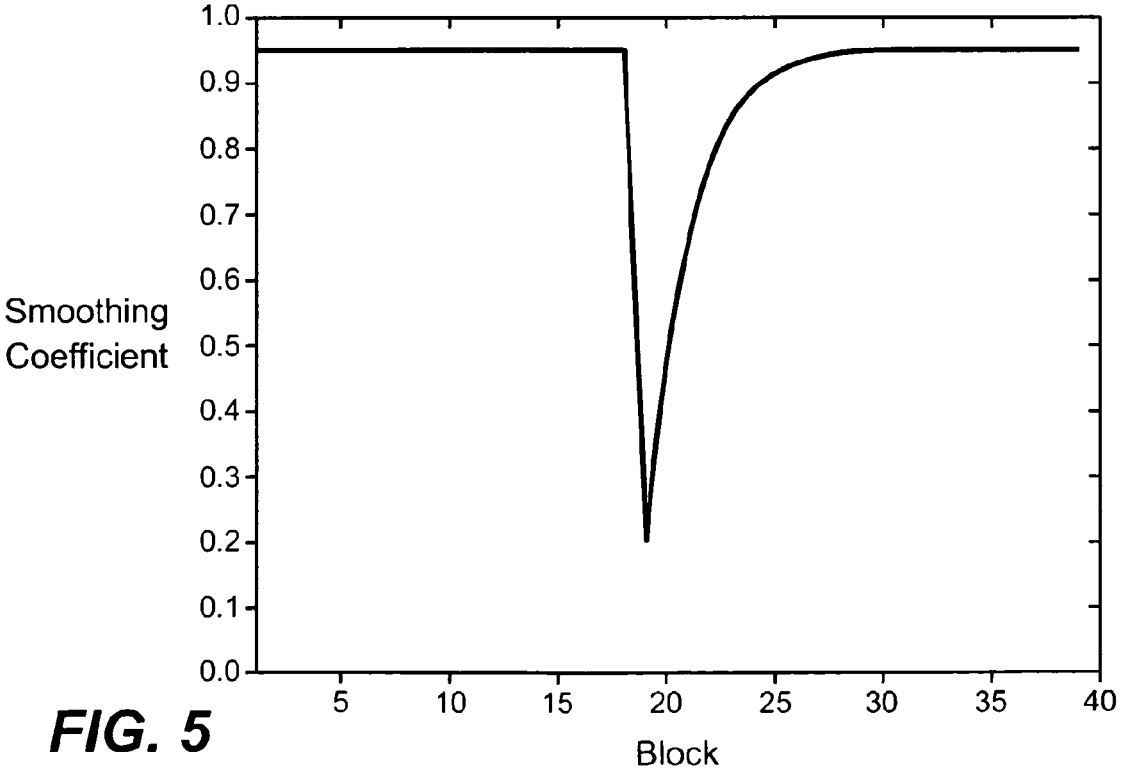
FIG. 5 shows, in a plot of Smoothing Coefficient (vertical axis) versus transform Block number (horizontal axis), an exemplary response of the alpha parameter of a signal dependent leaky integrator that may be used as an estimator used in reducing the time-variance of a measure of cross-correlation in practicing aspects of the present invention. The occurrence of an auditory event boundary appears as a sharp drop in the Smoothing Coefficient at the block boundary just before Block 20.

FIG. 5 shows an exemplary response of the alpha parameter (see Eqn. 1, just below) in a band when the onset of an auditory event is detected (the auditory event boundary is just before transform block 20 in the FIG. 5 example). Eqn. 1 describes a signal dependent leaky integrator that may be used as an estimator used in reducing the time-variance of a measure of cross-correlation (see also the discussion of Eqn. 4, below).

$$C'(n,b)=\alpha C'(n-1,b)+(1-\alpha)C(n,b) \quad (1)$$

Where: C(n,b) is the variable computed over a spectral band b at block n, and C'(n,b) is the variable after temporal smoothing at block n.

Surround Channel Calculations

Figure 6:
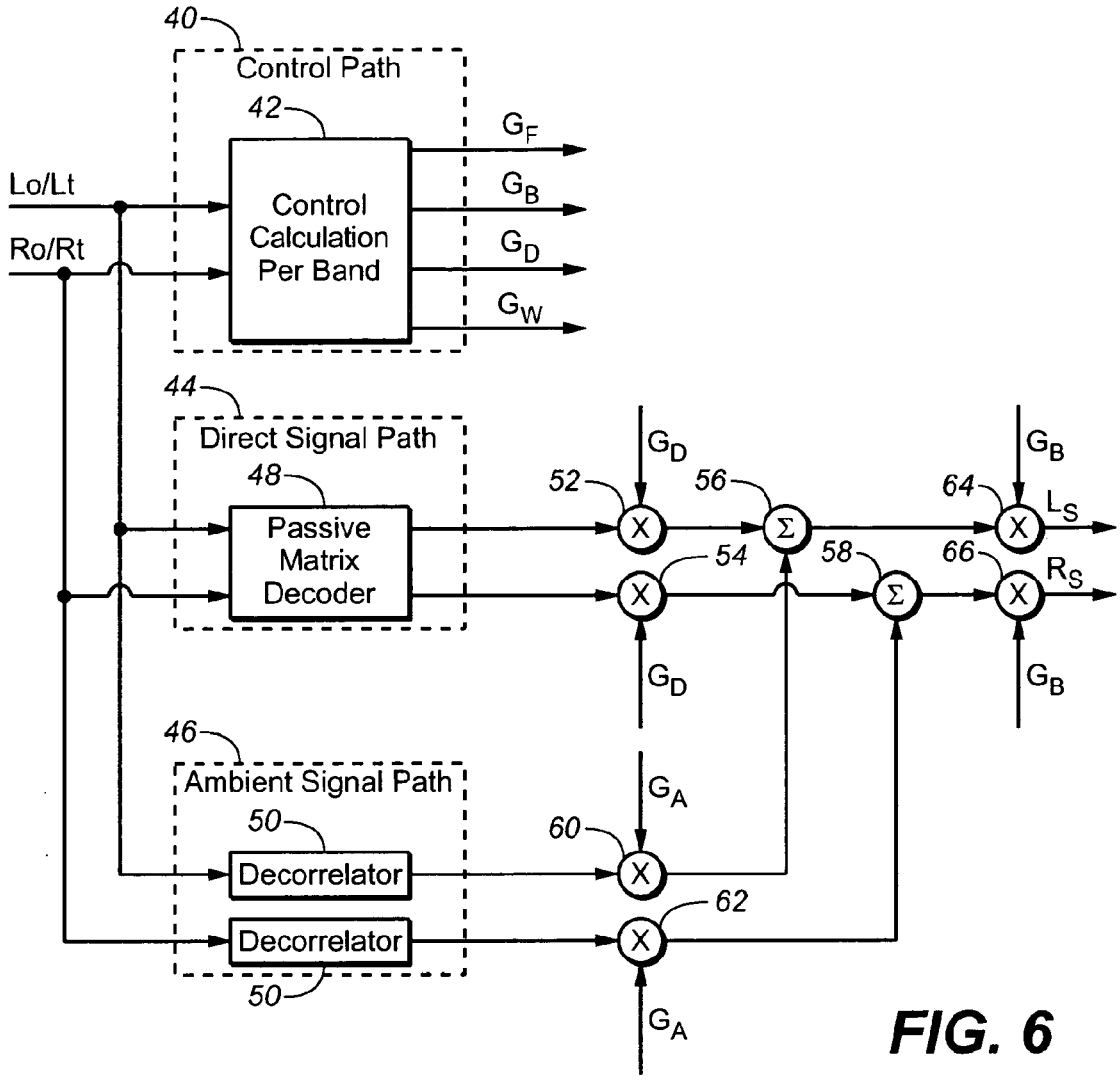
FIG. 6 shows a schematic functional block diagram of the surround-sound-obtaining portion of the audio upmixer or upmixing process of FIG. 2 in accordance with aspects of the present invention. For simplicity in presentation.

FIG. 6 shows, in greater detail, a schematic functional block diagram of the surround-sound-obtaining portion of the audio upmixer or upmixing process of FIG. 2 in accordance with aspects of the present invention. For simplicity in presentation, FIG. 6 shows a schematic of the signal flow in one of multiple frequency bands, it being understood that the combined actions in all of the multiple frequency bands produce the surround sound audio channels $L_S$ and $R_S$.

As indicated in FIG. 6, each of the input signals (Lo/Lt and Ro/Rt) is split into three paths. The first path is a "Control Path" 40, which, in this example, computes the front/back ratio gain scale factors ($G_F$ and $G_B$) and the direct/ambient ratio gain scale factors ($G_D$ and $G_A$) in a computer or computing function ("Control Calculation Per Band") 42 that includes a device or process (not shown) for providing a measure of cross correlation of the input signals. The other two paths are a "Direct Signal Path" 44 and an Ambience Signal Path 46, the outputs of which are controllably blended together under control of the $G_D$ and $G_A$ gain scale factors to provide a pair of surround channel signals $L_S$ and $R_S$. The direct signal path includes a passive matrix decoder or decoding process ("Passive Matrix Decoder") 48. Alternatively, an active matrix decoder may be employed instead of the passive matrix decoder to improve surround channel separation under certain signal conditions. Many such active and passive matrix decoders and decoding functions are well known in the art and the use of any particular one such device or process is not critical to the invention.

Optionally, to further improve the envelopment effect created by panning ambient signal components to the surround channels by application of the $G_A$ gain scale factor, the ambience signal components from the left and right input signals may be applied to a respective decorrelator or multiplied by a respective decorrelation filter sequence ("Decorrelator") 50 before being blended with direct image audio components from the matrix decoder 48. Although decorrelators 50 may be identical to each other, some listeners may prefer the performance provided when they are not identical. While any of many types of decorrelators may be used for the ambience signal path, care should be taken to minimize audible comb filter effects that may be caused by mixing decorrelated audio material with a non-decorrelated signal. A particularly useful decorrelator is described below, although its use is not critical to the invention.

The Direct Signal Path 44 may be characterized as including respective multipliers 52 and 54 in which the direct signal component gain scale factors $G_D$ are applied to the respective left surround and right surround matrix-decoded signal components, the outputs of which are, in turn, applied to respective additive combiners 56 and 58 (each shown as a summation symbol E). Alternatively, direct signal component gain scale factors $G_D$ may be applied to the inputs to the Direct Signal Path 44. The back gain scale factor $G_B$ may then be applied to the output of each combiner 56 and 58 at multipliers 64 and 66 to produce the left and right surround output $L_S$ and $R_S$. Alternatively, the $G_B$ and $G_D$ gain scale factors may be multiplied together and then applied to the respective left surround and right surround matrix-decoded signal components prior to applying the result to combiners 56 and 58.

The Ambient Signal Path may be characterized as including respective multipliers 60 and 62 in which the ambience signal component gain scale factors $G_A$ are applied to the respective left and right input signals, which signals may have been applied to optional decorrelators 50. Alternatively, ambient signal component gain scale factors $G_A$ may be applied to the inputs to Ambient Signal Path 46. The application of the dynamically-varying ambience signal component gain scale factors $G_A$ results in extracting ambience signal components from the left and right input signals whether or not any decorrelator 50 is employed. Such left and right ambience signal components are then applied to the respective additive combiners 56 and 58. If not applied after the combiners 56 and 58, the $G_B$ gain scale factor may be multiplied with the gain scale factor $G_A$ and applied to the left and right ambience signal components prior applying the result to combiners 56 and 58.

Surround sound channel calculations as may be required in the example of FIG. 6 may be characterized as in the following steps and substeps.

Step 1

Group Each of the Input Signals into Bands

As shown in FIG. 6, the control path generates the gain scale factors $G_F$, $G_B$, $G_D$ and $G_A$—these gain scale factors are computed and applied in each of the frequency bands. Note that the $G_F$ gain scale factor is not used in obtaining the surround sound channels—it may be applied to the front channels (see FIG. 2). The first step in computing the gain scale factors is to group each of the input signals into bands as shown in Eqns. 2 and 3.

$$\vec{L}(m, b) = \begin{bmatrix} L(m, L_b) \\ L(m, L_b + 1) \\ \vdots \\ L(m, U_b - 1) \end{bmatrix}^T, \tag{2}$$

$$\vec{R}(m, b) = \begin{bmatrix} R(m, L_b) \\ R(m, L_b + 1) \\ \vdots \\ R(m, U_b - 1) \end{bmatrix}^T, \tag{3}$$

Where: m is the time index, b is the band index, L(m,k) is $k^{th}$ spectral sample of the left channel at time m, R(m,k) is the $k^{th}$ spectral sample of the right channel at time m, $\overline{L}(m,b)$ is a column matrix containing the spectral samples of the left channel for band b, $\overline{R}(m,b)$ is an column matrix containing the spectral samples of the right channel for band b, $L_b$ is the lower bound of band b, and $U_b$ is the upper bound of band b.

Step 2

Compute a Measure of the Cross-Correlation Between the Two Input Signals in Each Band The next step is to compute a measure of the interchannel correlation between the two input signals (i.e., the "cross-correlation") in each band. In this example, this is accomplished in three substeps.

Substep 2a

Compute a Reduced-Time-Variance (Time-Smoothed) Measure of Cross-Correlation

First, as shown in Eqn. 4, compute a reduced-time-variance measure of interchannel correlation. In Eqn. 4 and other equations herein, E is an estimator operator. In this example, the estimator represents a signal dependent leaky integrator equation (such as in Eqn. 1). There are many other techniques that may be used as an estimator to reduce the time variance of the measured parameters (for example, a simple moving time average) and the use of any particular estimator is not critical to the invention.

$$\rho_{LR}(m, b) = \frac{\left|E\{\vec{L}(m, b) \cdot \vec{R}(m, b)^T\}\right|}{\sqrt{E\{\vec{L}(m, b) \cdot \vec{L}(m, b)^T\} \cdot E\{\vec{R}(m, b) \cdot \vec{R}(m, b)^T\}}}, \tag{4}$$

Where: T is the Hermitian transpose, $\rho_{LR}(m,b)$ is an estimate of the correlation coefficient between the left and right channel in band b at time m. $\rho_{LR}(m,b)$ may have a value ranging from zero to one. The Hermitian transpose is both a transpose and a conjugation of the complex terms. In Eqn. 4, for example, $\overline{L}(m,b)\cdot\overline{R}(m,b)^T$ results in a complex scalar as $\overline{L}(m,b)$ and $\overline{R}(m,b)$ are complex row vectors as defined in Eqns. 1 and 2.

Substep 2b

Construct a Biased Measure of Cross-Correlation

The correlation coefficient may be used to control the amount of ambient and direct signal that is panned to the surround channels. However, if the left and right signals are completely different, for example two different instruments are panned to left and right channels, respectively, then the cross correlation is zero and the hard-panned instruments would be panned to the surround channels if an approach such as in Substep 2a is employed by itself. To avoid such a result, a biased measure of the cross correlation of the left and right input signals may be constructed, such as shown in Eqn. 5.

$$\phi_{LR}(m, b) = \frac{\left|E\{\vec{L}(m, b) \cdot \vec{R}(m, b)^T\}\right|}{\max\left(E\{\vec{L}(m, b) \cdot \vec{L}(m, b)^T\}, E\{\vec{R}(m, b) \cdot \vec{R}(m, b)^T\}\right)}, \tag{5}$$

$\phi_{LR}(m,b)$ may have a value ranging from zero to one.

Where: $\phi_{LR}(m,b)$ is the biased estimate of the correlation coefficient between the left and right channels.

The "max" operator in the denominator of Eqn. 4 results in the denominator being either the maximum of either $E\{\overline{L}(m,b)\cdot\overline{L}(m,b)^T\}$ or $E\{\overline{R}(m,b)\cdot\overline{L}(m,b)^T\}$. Consequently, the cross correlation is normalized by either the energy in the left signal or the energy in the right signal rather than the geometric mean as in Eqn. 4. If the powers of the left and right signal are different, then the biased estimate of the correlation coefficient $\phi_{LR}(m,b)$ of Eqn. 5 leads to smaller values than those generated by the correlation coefficient $\rho_{LR}(m,b)$ of in Eqn. 4. Thus, the biased estimate may be used to reduce the degree of panning to the surround channels of instruments that are hard panned left and/or right.

Substep 2c

Combine the Unbiased and Biased Measures of Cross-Correlation

Next, combine the unbiased cross correlation estimate given in Eqn. 4 with the biased estimate given in Eqn. 5 into a final measure of the interchannel correlation, which may be used to control the ambience and direct signal panning to the surround channels. The combination may be expressed as in Eqn. 6, which shows that the interchannel coherence is equal to the correlation coefficient if the biased estimate of the correlation coefficient (Eqn. 5) is above a threshold; otherwise the interchannel coherence approaches unity linearly. The goal of Eqn. 6 is to ensure that instruments that are hard panned left and right in the input signals are not panned to the surround channels. Eqn. 6 is only one possible way of many to achieve such a goal.

$$\gamma(m,b)=\begin{cases}\rho_{LR}(m,b) & \phi_{LR}\geq\mu_0\\ \rho_{LR}(m,b)+\dfrac{(\mu_0-\phi_{LR}(m,b))}{\mu_0} & \phi_{LR}<\mu_0,\end{cases}\tag{6}$$

Where: $\mu_0$ is a predefined threshold. The threshold should be as small as possible, but preferably not zero. It may be approximately equal to the variance of the estimate of the biased correlation coefficient $\phi_{LR}(m,b)$.

Step 3

Calculate the Front and Back Gain Scale Factors $G_F$ and $G_B$

Next, calculate the front and back gain scale factors $G_F$ and $G_B$. In this example, this is accomplished in three substeps. Substeps 3a and 3b may be performed in either order or simultaneously.

Substep 3a

Calculate Front and Back Gain Scale Factors $G_F'$ and $G_R'$ Due to Ambience Signals Only Next, calculate a first intermediate set of front/back panning gain scale factors ($G_F'$ and $G_B'$) as shown in Eqns. 7 and 8, respectively. These represent the desired amount of back/front panning due to the detection of ambience signals only; the final back/front panning gain scale factors, as described below, take into account both the ambience panning and the surround image panning.

$$G_F'(m,b)=\partial_0+(1-\partial_0)\sqrt{\gamma(m,b)},\tag{7}$$

$$G_B'(m,b)=\sqrt{1-(G_F'(m,b))^2},\tag{8}$$

Where: $\partial_0$ is a predefined threshold and controls the maximum amount of energy that can be panned into the surround channels from the front sound field. The threshold $\partial_0$ may be selected by a user to control the amount of ambient content sent to the surround channels.

Although the expressions for $G_F'$ and $G_B'$ in Eqns. 7 and 8 are suitable and preserve power, they are not critical to the invention. Other relationships in which $G_F'$ and $G_B'$ are generally inverse to each other may be employed.

Figure 7:
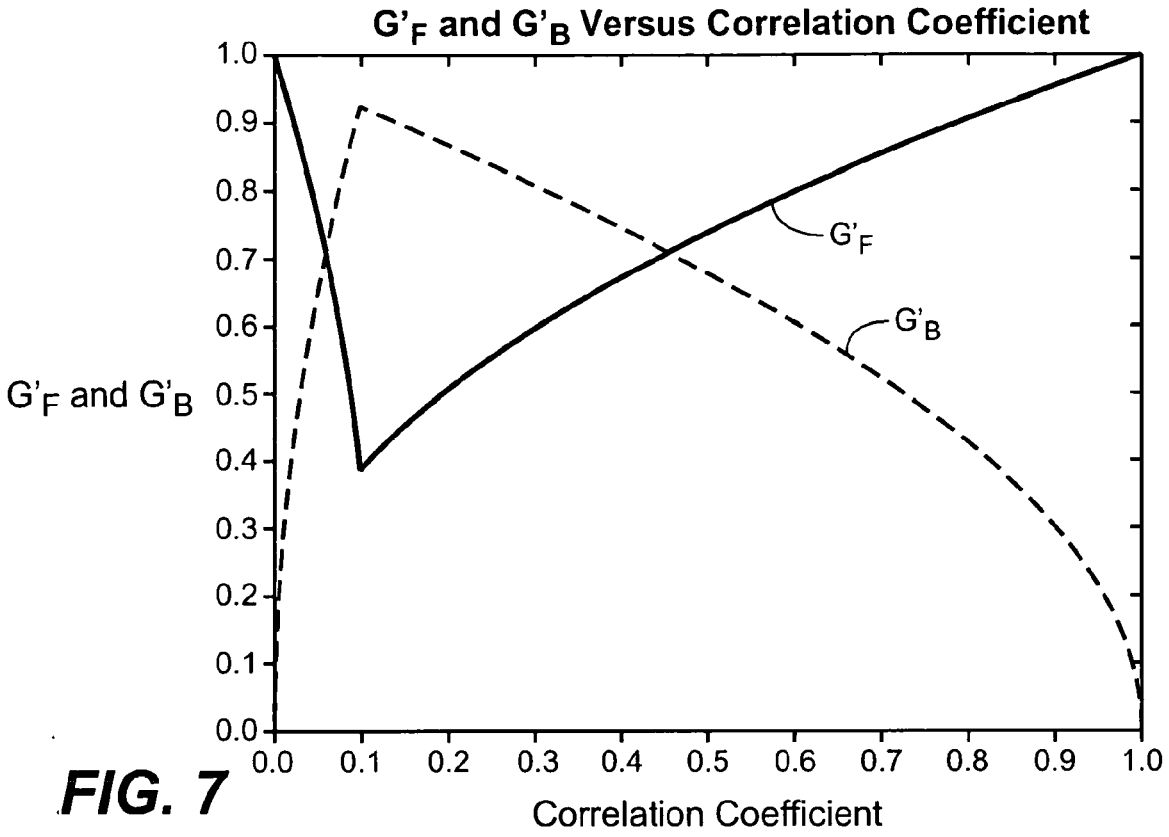
FIG. 7 shows a plot of the gain scale factors $G_F'$ and $G_B'$ (vertical axis) versus the correlation coefficient ($\rho_{LR}(m,b)$) (horizontal axis).

FIG. 7 shows a plot of the gain scale factors $G_F'$ and $G_B'$ versus the correlation coefficient ($\rho_{LR}(m,b)$). Notice that as the correlation coefficient decreases, more energy is panned to the surround channels. However, when the correlation coefficient falls below a certain point, a threshold $\mu_0$, the signal is panned back to the front channels. This prevents hard-panned isolated instruments in the original left and right channels from being panned to the surround channels. FIG. 7 shows only the situation in which the left and right signal energies are equal; if the left and right energies are different, the signal is panned back to the front channels at a higher value of the correlation coefficient. More specifically, the turning point, threshold $\mu_0$, occurs at a higher value of the correlation coefficient.

Substep 3b

Calculate Front and Back Gain Scale Factors $G_F''$ and $G_B''$Due to Matrix-Decoded Direct Signals Only So far, how much energy to put into the surround channels due to the detection of ambient audio material has been decided; the next step is to compute the desired surround channel level due to matrix-decoded discrete images only. To compute the amount of energy in the surround channels due to such discrete images, first estimate the real part of the correlation coefficient of Eqn. 4 as shown in Eqn. 9.

$$\lambda_{LR}(m,b)=\frac{\mathcal{R}\{E\{\vec{L}(m,b)\cdot\vec{R}(m,b)^T\}\}}{\sqrt{E\{\vec{L}(m,b)\cdot\vec{L}(m,b)^T\}\cdot E\{\vec{R}(m,b)\cdot\vec{R}(m,b)^T\}}},\tag{9}$$

Due to a 90-degree phase shift during the matrix encoding process (down mixing), the real part of the correlation coefficient smoothly traverses from 0 to −1 as an image in the original multichannel signal, before downmixing, moves from the front channels to the surround channels. Hence, one may construct a further intermediate set of front/back panning gain scale factors as shown in Eqns. 10 and 11.

$$G_F''(m,b)=1+\lambda_{LR}(m,b)\tag{10}$$

$$G_B''(m,b)=\sqrt{1-(G_F''(m,b))^2},\tag{11}$$

Where $G_F''(m,b)$ and $G_B''(m,b)$ are the front and back gain scale factors for the matrix-decoded direct signal respectively for band b at time m.

Although the expressions for $G_F''(m,b)$ and $G_B''(m,b)$ in Eqns. 10 and 11 are suitable and preserve energy, they are not critical to the invention. Other relationships in which $G_F''(m,b)$ and $G_B''(m,b)$ are generally inverse to each other may be employed.

Substep 3c

Using the Results of Substeps 3a and 3b, Calculate a Final Set of Front and Back Gain Scale Factors $G_F$ and $G_B$ Now calculate a final set of front and back gain scale factors as given by Eqns. 12 and 13.

$$G_F(m,b)=\mathrm{MIN}(G_F'(m,b),G_F''(m,b)) \tag{12}$$

$$G_B(m,b)=\sqrt{1=(G_F(m,b))^2} \tag{13}$$

Where MIN means that the final front gain scale factor $G_F(m,b)$ is equal to $G_F'(m,b)$ if $G_F'(m,b)$ is less than $G_F''(m,b)$ otherwise $G_F(m,b)$ is equal to $G_F''(m,b)$.

Although the expressions for $G_F$ and $G_B$ in Eqns. 10 and 11 are suitable and preserve energy, they are not critical to the invention. Other relationships in which $G_F$ and $G_B$ are generally inverse to each other may be employed.

Step 4

Calculate the Ambient and Matrix-Decoded Direct Gain Scale Factors $G_D$ and $G_A$ At this point, the amount of energy that is sent to the surround channels due to both the ambience signal detection and the matrix-decoded direct signal detection has been determined. However, one now needs to control the amount of each signal type that is present in the surround channels. To calculate the gain scale factors that control the cross blending between direct and ambience signals ($G_D$ and $G_A$), one may use the correlation coefficient $\rho_{LR}(m,b)$ of Eqn. 4. If the left and right input signals are relatively uncorrelated, then more of the ambience signal components than the direct signal components should be present in the surround channels; if the input signals are well correlated then more of the direct signal components than the ambience signal components should be present in the surround channels. Hence, one may derive the gain scale factors for the direct/ambient ratio as shown in Eqn. 14.

$$\begin{aligned} G_D(m,b) &= \rho_{LR}(m,b) \\ G_A(m,b) &= \sqrt{(1-(\rho_{LR}(m,b))^2)}\,, \end{aligned} \tag{14}$$

Although the expressions for $G_D$ and $G_A$ in Eqn. 14 are suitable and preserve energy, they are not critical to the invention. Other relationships in which $G_D$ and $G_A$ are generally inverse to each other may be employed.

Step 5

Construct Matrix-Decoded and Ambience Signal Components

Next. construct the matrix-decoded and ambience signal components. This may be accomplished in two substeps, which may be performed in either order or simultaneously.

Substep 5a

Construct Matrix-Decoded Signal Components for Band b

Construct the matrix-decoded signal components for band b as shown, for example, in Eqn. 15.

$$\begin{aligned} \vec{L}_D(m,b) &= -\alpha\cdot\vec{L}(m,b)-\beta\cdot\vec{R}(m,b) \\ \vec{R}_D(m,b) &= \beta\cdot\vec{L}(m,b)+\alpha\cdot\vec{R}(m,b), \end{aligned} \tag{15}$$

Where $\vec{L}_D(m,b)$ is the matrix decoded signal components from the matrix decoder for the left surround channel in band b at time m and $\vec{R}_D(m,b)$ is the matrix-decoded signal components from the matrix decoder for the right surround channel in band b at time m.

Step 5b

Construct Ambient Signal Components for Band b

The application of the gain scale factor $G_A$, which dynamically varies at the time-smoothed transform block rate, functions to derive the ambience signal components. (See, for example, reference 1.) The dynamically-varying the gain scale factor $G_A$ may be applied before or after the ambient signal path 46 (FIG. 6). The derived ambience signal components may be further enhanced by multiplying the entire spectrum of the original left and right signal by the spectral domain representation of the decorrelator. Hence, for band b and time m, the ambience signals for the left and right surround signals are given, for example, by Eqns. 16 and 17.

$$\vec{L}_A(m,b)=\begin{bmatrix} L(m,L_b)\cdot D^L(L_b) \\ L(m,L_b+1)\cdot D^L(L_b+1) \\ \vdots \\ L(m,U_b-1)\cdot D^L(U_b-1) \end{bmatrix}^T, \tag{16}$$

Where $\vec{L}_A(m,b)$ is the ambience signal for the left surround channel in band b at time m and $D^L(k)$ is the spectral domain representation of the left channel decorrelator at bin k.

$$\vec{R}_A(m,b)=\begin{bmatrix} R(m,L_b)\cdot D^R(L_b) \\ R(m,L_b+1)\cdot D^R(L_b+1) \\ \vdots \\ R(m,U_b-1)\cdot D^R(U_b-1) \end{bmatrix}^T, \tag{17}$$

Where $\vec{R}_A(m,b)$ is the ambience signal for the right surround channel in band b at time m and $D^R(k)$ is the spectral domain representation of the right channel decorrelator at bin k.

Step 6

Apply Gain Scale Factors $G_B$, $G_D$, $G_A$ to Obtain Surround Channel Signals

Having derived the control signal gains $G_B$, $G_D$, $G_A$ (steps 3 and 4) and the matrix-decoded and ambient signal components (step 5), one may apply them as shown in FIG. 6 to obtain the final surround channel signals in each band. The final output left and right surround signals may now be given by Eqn. 18.

$$\begin{aligned} \vec{L}_S(m,b) &= G_B\cdot\left(G_A\cdot\vec{L}_A(m,b)+G_D\cdot\vec{L}_D(m,b)\right) \\ \vec{R}_S(m,b) &= G_B\cdot\left(G_A\cdot\vec{R}_A(m,b)+G_D\cdot\vec{R}_D(m,b)\right) \end{aligned} \tag{18}$$

Where $\vec{L}_S(m,b)$ and $\vec{R}_S(m,b)$ are the final left and right surround channel signals in band b at time m.

As noted above in connection with Step 5b, it will be appreciated that the application of the gain scale factor $G_A$, which dynamically varies at the time-smoothed transform block rate, may be considered to derive the ambience signal components.

The surround sound channel calculations may be summarized as follows.

1. Group each of the input signals into bands (Eqns. 2 and 3).
2. Compute a measure of the cross-correlation between the two input signals in each band.
   a. Compute a reduced-time-variance (time-smoothed) measure of cross-correlation (Eqn. 4)
   b. Construct a biased measure of cross-correlation (Eqn. 5)
   c. Combine the unbiased and biased measures of cross-correlation (Eqn. 6)
3. Calculate the front and back gain scale factors $G_F$ and $G_B$
   a. Calculate front and back gain scale factors $G_F'$ and $G_B'$ due to ambient signals only (Eqns. 7, 8)
   b. Calculate front and back gain scale factors $G_F''$ and $G_B''$ due to matrix-decoded direct signals only (Eqn. 10, 11)
   c. Using the results of substeps 3a and 3b, calculate a final set of front and back gain scale factors $G_F$ and $G_B$ (Eqns. 12, 13)
4. Calculate the ambient and matrix-decoded direct gain scale factors $G_D$ and $G_A$ (Eqn. 14)
5. Construct matrix-decoded and ambient signal components
   a. Construct matrix-decoded signal components for band b (Eqn. 15)
   b. Construct ambient signal components for band b (Eqns. 16, 17, application of $G_A$)
6. Apply gain scale factors $G_B$, $G_D$, $G_A$ to constructed signal components to obtain surround channel signals (Eqn. 18)

Alternatives

One suitable implementation of aspects of the present invention employs processing steps or devices that implement the respective processing steps and are functionally related as set forth above. Although the steps listed above may each be carried out by computer software instruction sequences operating in the order of the above listed steps, it will be understood that equivalent or similar results may be obtained by steps ordered in other ways, taking into account that certain quantities are derived from earlier ones. For example, multi-threaded computer software instruction sequences may be employed so that certain sequences of steps are carried out in parallel. As another example, the ordering of certain steps in the above example is arbitrary and may be altered without affecting the results—for example, substeps 3a and 3b may be reversed and substeps 5a and 5b may be reversed. Also, as will be apparent from inspection of Eqn. 18, the gain scale factor $G_B$ need not be calculated separately from the calculation of the gain scale factors $G_A$ and $G_D$—a single gain scale factor $G_B \cdot G_A$ and a single gain scale factor $G_B \cdot G_D$ may be calculated and employed in a modified form of Eqn. 18 in which the gain scale factor $G_B$ is brought within the parentheses. Alternatively, the described steps may be implemented as devices that perform the described functions, the various devices having functional interrelationships as described above.

Decorrelators for Surround Channels

To improve the separation between front channels and surround channels (or to emphasize the envelopment of the original audio material) one may apply decorrelation to the surround channels. Decorrelation, as next described, may be similar to those proposed in reference 5. Although the decorrelator next described has been found to be particularly suitable, its use is not critical to the invention and other decorrelation techniques may be employed.

The impulse response of each filter may be specified as a finite length sinusoidal sequence whose instantaneous frequency decreases monotonically from $\pi$ to zero over the duration of the sequence:

$$h_i[n] = G_i\sqrt{|\omega_i'(n)|}\cos(\phi_i(n)),\ n = 0 \ldots L_i \tag{19}$$

$$\phi_i(t) = \int \omega_i(t)dt,$$

where $\omega_i(t)$ is the monotonically decreasing instantaneous frequency function, $\omega_i'(t)$ is the first derivative of the instantaneous frequency, $\phi_i(t)$ is the instantaneous phase given by the integral of the instantaneous frequency, and $L_i$ is the length of the filter. The multiplicative term $\sqrt{|\omega_i'(t)}$ is required to make the frequency response of $h_i[n]$ approximately flat across all frequency, and the gain $G_i$ is computed such that:

$$\sum_{n=0}^{L_i} h_i^2[n] = 1, \tag{20}$$

The specified impulse response has the form of a chirp-like sequence and, as a result, filtering audio signals with such a filter may sometimes result in audible "chirping" artifacts at the locations of transients. This effect may be reduced by adding a noise term to the instantaneous phase of the filter response:

$$h_i[a] = G_i\sqrt{|\omega_i'(n)|}\cos(\phi_i(n)+N_i[n]) \tag{21}$$

Making this noise sequence $N_i[n]$ equal to white Gaussian noise with a variance that is a small fraction of $\pi$ is enough to make the impulse response sound more noise-like than chirp-like, while the desired relation between frequency and delay specified by $\omega_i(t)$ is still largely maintained.

At very low frequencies, the delay created by the chirp sequence is very long, thus leading to audible notches when the upmixed audio material is mixed back down to two channels. To reduce this artifact; the chirp sequence may be replaced with a 90 degree phase flip at frequencies below 2.5 kHz. The phase is flipped between positive and negative 90 degrees with the flip occurring with logarithmic spacing.

Because the upmix system employs STDFT with sufficient zero padding (described above) the decorrelator filters given by Eqn. 21 may be applied using multiplication in the spectral domain.

Implementation

The invention may be implemented in hardware or software, or a combination of both (e.g., programmable logic arrays). Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The invention may also be considered to be implemented as a computer-readable storage medium, configured with a computer program, where the storage medium so configured causes a computer system to operate in a specific and predefined manner to perform the functions described herein.

A number of embodiments of the invention have, been described. Nevertheless, it will be understood that various modifications may be made without departing from the spirit and scope of the invention. For example, as also mentioned above, some of the steps described herein may be order independent, and thus can be performed in an order different from that described.

The invention claimed is:

1. A method for obtaining two surround sound audio channels from two input audio signals, wherein said audio signals comprise components generated by matrix encoding, comprising obtaining ambience signal components from said audio signals, obtaining matrix-decoded direct signal components from said audio signals using a matrix decoder that receives the input audio signals having direct and ambient signal components, and that are denoted Lo/Lt and Ro/Rt, and controllably combining ambience signal components and matrix-decoded signal components using gain scale factors obtained in a time-frequency domain by:

splitting each of the input signals Lo/Lt and Ro/Rt into three paths comprising a control path that computes front/back ratio gain scale factors and direct/ambient gain scale factors, a direct signal path, and an ambience signal path;

calculating front and back gain scale factors for each path, and direct and ambient gain scale factors for each path; and blending each direct signal path with a respective ambience signal path using the direct/ambient gain scale factors to provide right and left surround channel signals by applying the calculated back, direct and ambient gain scale factors to the ambience signal components and the matrix-decoded signal components.

2. A method according to claim 1 wherein obtaining ambience signal components includes applying a dynamically changing ambience signal component gain scale factor to one of said input audio signals and wherein said gain scale factors include the dynamically changing ambience signal component gain scale factor applied in obtaining ambience signal components.

3. A method according to claim 2 wherein obtaining matrix-decoded signal components includes applying a matrix decoding to said input audio signals, which matrix decoding is adapted to provide first and second audio signals each associated with a rear surround sound direction, and wherein said gain scale factors further include a dynamically changing matrix-decoded signal component gain scale factor applied to each of the first and second audio signals associated with a rear surround sound direction.

4. A method according to claim 1 further comprising inputting the ambience signal paths through respective decorrelators before blending with the direct signal paths to improve an envelopment effect.

5. A method according to claim 4 wherein said matrix-decoded signal component gain scale factor is a function of a measure of cross-correlation of said input audio signals, and wherein the dynamically changing matrix-decoded signal component gain scale factor increases as the degree of cross-correlation increases and decreases as the degree of cross-correlation decreases.

6. A method according to claim 5 wherein the dynamically changing matrix-decoded signal component gain scale factor and the dynamically changing ambience signal component gain scale factor increase and decrease with respect to each other in a manner that preserves the combined energy of the matrix-decoded signal components and ambience signal components.

7. A method according to claim 3 wherein said gain scale factors further include a dynamically changing surround sound audio channels' gain scale factor for further controlling the gain of the surround sound audio channels.

8. A method according to claim 7 wherein the surround sound audio channels' gain scale factor is a function of a measure of cross-correlation of said input audio signals.

9. A method according to claim 8 wherein the function causes the surround sound audio channels gain scale factor to increase as the measure of cross-correlation decreases up to a value below which the surround sound audio channels' gain scale factor decreases.

10. A method according to claim 9 wherein the method is performed in the time-frequency domain.

11. A method according to claim 10 wherein the method is performed in one or more frequency bands in the time-frequency domain.

12. A method according to claim 2 wherein said ambience signal component gain scale factor is a function of a measure of cross-correlation of said input audio signals.

13. A method according to claim 12 wherein the ambience signal component gain scale factor decreases as the degree of cross-correlation increases and vice-versa.

14. A method according to claim 12 wherein said measure of cross-correlation is temporally smoothed by one of a signal dependent leaky integrator process, a moving average process, and a signal adaptive process.

15. A method according to claim 1 wherein the front/back ratio gain scale factors of the control path comprise a set of final set of gain scale factors computed by calculating front and back gain scale factors due to the ambience signal components only and calculating front and back gain scale factors due to the matrix-decoded direct signal components only and applying one of an energy preservation calculation or an inverse relationship calculation between intermediate front and back gain scale factors.

16. A method according to claim 1 wherein the direct/ambient gain scale factors are calculated by applying one of an energy preservation calculation or an inverse relationship calculation between the direct and ambient gain scale factors.

17. A method according to claim 14 wherein the temporal smoothing is signal adaptive.

18. A method according to claim 17 wherein the temporal smoothing adapts in response to changes in spectral distribution.

19. A method according to claim 4 wherein obtaining ambience signal components includes applying at least one decorrelation filter sequence.

20. A method according to claim 19 wherein the same decorrelation filter sequence is applied to each of said input audio signals.

21. A method according to claim 19 wherein a different decorrelation filter sequence is applied to each of said input audio signals.

22. A non-transitory computer-readable storage medium encoded with a computer program for causing a computer to perform the method of claim 1.

23. Apparatus for obtaining two surround sound audio channels from two input audio signals, wherein said audio signals comprise components generated by matrix encoding, comprising means for obtaining ambience signal components from said audio signals, means for obtaining matrix-decoded direct signal components from said audio signals using a matrix decoder that receives the input audio signals having direct and ambient signal components, and that are denoted Lo/Lt and Ro/Rt, and means for controllably combining ambience signal components and matrix-decoded signal components using gain scale factors obtained in a time-frequency domain by:

splitting each of the input signals Lo/Lt and Ro/Rt into three paths comprising a control path that computes front/back ratio gain scale factors and direct/ambient gain scale factors, a direct signal path, and an ambience signal path;

calculating front and back gain scale factors for each path, and direct and ambient gain scale factors for each path; and blending each direct signal path with a respective ambience signal path using the direct/ambient gain scale factors to provide right and left surround channel signals by applying the calculated back, direct and ambient gain scale factors to the ambience signal components and the matrix-decoded signal components.

* * * * *